US007334533B2

(12) United States Patent
Tajima

(10) Patent No.: US 7,334,533 B2
(45) Date of Patent: Feb. 26, 2008

(54) SEQUIN FEEDER DEVICE

(75) Inventor: Ikuo Tajima, Nagoya (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/483,370

(22) Filed: Jul. 7, 2006

(65) Prior Publication Data

US 2007/0028819 A1 Feb. 8, 2007

(30) Foreign Application Priority Data

Jul. 8, 2005 (JP) ..... 2005-200171

(51) Int. Cl.
*D05B 3/22* (2006.01)
*D05B 3/12* (2006.01)

(52) U.S. Cl. ..... 112/99; 112/113

(58) Field of Classification Search ..... 112/99, 112/152, 153, 88, 110, 136, 113
See application file for complete search history.

(56) References Cited

U.S. PATENT DOCUMENTS 3,054,367 A * 9/1962 Loiselle ..... 112/152
5,035,192 A * 7/1991 Nirenberg et al. ..... 112/110
5,562,057 A * 10/1996 Lenson ..... 112/88
5,715,765 A * 2/1998 Ng ..... 112/141
5,755,168 A * 5/1998 Gunther et al. ..... 112/113
6,165,046 A * 12/2000 Boser ..... 450/41
7,082,884 B2 * 8/2006 Tajima et al. ..... 112/99

* cited by examiner

*Primary Examiner*—Ismael Izgauirre
(74) *Attorney, Agent, or Firm*—Rossi, Kimms & McDowell LLP

(57) ABSTRACT

Sequin feeder device includes an adjustment member mounted on a feed lever, and the adjustment member controls pivot timing of a lock lever by its adjustment piece abutting against a lock lever. The pivot timing of the lock lever is adjustable as desired, in accordance with a relative position of the adjustment piece, and thus, timing at which an engaging claw of the lock lever engages a sequin is adjustable as desired. Further, on a support plate, there is mounted a sequin feed guide member for guiding a continuous sequin strip to allow the sequin strip to be fed straight in the predetermined feeding direction. The sequin feed guide member can be appropriately positioned by merely being fixed to the support plate with its side edge abutted against a side wall of the support plate, without a need for particular positional adjustment of the guide member.

7 Claims, 10 Drawing Sheets

SEQUIN FEEDER DEVICE

BACKGROUND OF THE INVENTION

The present invention relates to sequin feeder device for use in sewing machines which sew a sequin onto a sewing workpiece while severing the sequin from a ribbon or strip of continuously-connected sequins.

One example of sequin feeder devices for use in sewing machines is known from Japanese Patent Application Laid-open Publication No. 2004-167097. This known sequin feeder device includes a feed lever for feeding a strip of a multiplicity of continuously-connected sequins (spangles) played out or let out from a reel and then placed on the upper surface of a support plate and a lock lever for immovably locking the strip of continuously-connected sequins (continuous sequin strip) at the end of the sequin feeding operation by the feed lever. In this type of sequin feeder device, the feed lever feeds the strip of continuously-connected sequins (continuous sequin strip) by causing its distal-end engaging portion to engage a sewing hole of a predetermined one of the sequins of the continuous sequin strip and moving forward the distal-end engaging portion together with the predetermined sequin. Through repetition of such forward (or advancing) movement and subsequent rearward (or retracting) movement of the feed lever, sequins of the continuous sequin strip can be sequentially engaged and fed, by the distal-end engaging portion, one sequin at a time. The lock lever, which is pivotably supported near the feed lever, is positioned in such a manner that an engaging claw provided at the distal end of the lock lever extends through a through-hole, formed in the feed lever, and normally biased, via a spring or the like, so that the engaging claw of the lock lever is brought into engagement with the sewing hole of one of the sequins. At the end of the sequin feeding operation by the feed lever, the engaging claw of the lock lever can immovably lock the continuous sequin strip by the engaging claw engaging the sequin hole in one of the sequins of the strip. Operational relationship between the feed lever and the lock lever is briefed below. As the feed lever retracts, the peripheral edge of the through-hole in the feed lever abuts against the lock lever to push rearward the lock lever, so that the engagement, by the engaging claw of the lock lever, of the sewing hole of the sequin can be released. Conversely, as the feed lever advances, the peripheral edge of the through-hole in the feed lever disengages from the lock lever so that the lock lever is brought into a freely pivotable state, and thus, the biasing force of the spring or the like causes the engaging claw of the lock lever to abut against the upper surface of a predetermined one of the sequins. Then, as the feed lever further advances, the engaging claw having abutted against the sequin slides on the sequin's upper surface relatively to the latter. When the feed lever has completed the sequin feeding operation, the engaging claw of the lock lever engages the sewing hole of a sequin to thereby immovably lock the continuous sequin strip.

In the conventionally-known sequin feeder device arranged in the aforementioned manner, the lock lever, abutting against the peripheral edge of the through-hole of the feed lever, pivots in a direction away from a sequin in response to the retracting movement of the feed lever and in a direction toward the sequin in response to the advancing operation of the feed lever. In other words, during the advancing or sequin feeding stroke of the feed lever, the peripheral edge of the through-hole of the feed lever functions to control timing at which the engaging claw of the lock lever starts moving down toward the sequin. Length of one stroke of the advancing and retracting movement (i.e., sequin feeding operation) of the feed lever corresponds to the size of each sequin of the continuous sequin strip. The through-hole of the feed lever, on the other hand, has a relatively large size (particularly, a large length in the sequin feeding direction) so as to appropriately deal with sequins of various sizes, but the size of the through-hole is determined without adjustment of the moving-down timing of the engaging claw according to the sequin size being taken into account. Thus, during the advancing or sequin feeding operation of the feed lever in the conventionally-known sequin feeder device, the lock lever is brought into the free state the moment it disengages the peripheral edge of the through-hole of the feed lever, so that the engaging claw would slide on the upper surface of the sequin over a relatively long distance, as noted above. Thus, depending on the material of the sequin, there would arise the inconvenience that the engaging claw forms an unwanted sliding mark in the surface of the sequin.

There are presently available sequins of various shapes. In recent years, modified sequins have appeared which have the sewing hole offset from the center of the sequin, as illustrated in FIGS. 14A and 14B, in order to enhance the decorativeness of a product with such sequins sewn thereto. However, the following inconveniences would be encountered in cases where sequins having the sewing hole offset from the sequin center as illustrated in FIGS. 14A and 14B are fed by the conventional sequin feeder device. Namely, because the through-hole of the feed lever of the conventional sequin feeder device has a relatively large size (particularly, a great length in the sequin feeding direction) as noted above, there is a possibility of the lock lever being brought into the free state at a position short of a boundary or connecting portion between the sequins, depending on the size of the sequins, as seen from FIGS. 15A and 15B. More specifically, FIG. 15A shows how the feed lever feeds a sequin having the sewing hole in the center of the sequin, while FIG. 15B shows how the feed lever feeds a sequin having the sewing hole offset from the center of the sequin. In each of the illustrated examples of FIGS. 15A and 15B, the engaging claw 33*a* of the lock lever 33 is resiliently abutting against the upper surface of the sequin (by the biasing force of the spring or the like). As the feed lever advances, the continuous sequin strip is fed in a direction of arrow A, and the engaging claw 33*a* slides in a direction of arrow B on the upper surfaces of adjoining sequins relatively to the latter. In the case where the sequins are of the type having the sewing hole in the sequin center, the engaging claw 33*a* slides on the connecting portion between the adjoining sequins onto the upper surface of the succeeding sequin (see FIG. 15A). On the other hand, in the case where the sequins are of the type having the dewing hole offset from the sequin center, the engaging claw 33*a* of the lock lever 33 slides over a region indicated by reference character "C" (where adjoining sequins are spaced apart from each other by a gap) remotely from the connecting portion because the engaging claw 33*a* has been adjusted in advance to fit into the offset sewing hole of each of the sequins. Thus, when the engaging claw 33*a* is located over the C region, it tends to get into the gap between the adjoining sequins due to the biasing force imparted to the lock lever 33. Then, as the feed lever further advances in this state, the engaging claw 33*a*, having gotten into the gap, interferes with the outer peripheral edge of the succeeding sequin, so that the continuous sequin strip would undesirably meander or deform away from the engaging claw 33*a*.

Further, in the conventionally-known sequin feeder device, the sequin feeding operation is performed with only one point, where the distal end of the feed lever engages the sequin sewing hole, functioning as the supporting point. Thus, in the case where the sequins of the continuous sequin strip are of the type having the sewing hole offset from the center, particularly in a direction perpendicular to the feeding direction of the continuous sequin strip (as illustrated in FIGS. 14A, 14B, etc.), there would be produced a force that causes the continuous sequin strip to turn about the neighborhood of the connecting portion between adjoining sequins, which would undesirably deform the connecting portion and incline the sequins (about the vertical axis). Improved sequin feeder device constructed to avoid such an inconvenience has also been popularly known, which is equipped with a guide member for guiding a continuous sequin strip so as to allow the sequin strip to be fed straight in a predetermined feeding direction. Among examples of the conventionally-known guide members are one which has a pair of opposed left and right side walls for controlling positions of the left and right edges of the continuous sequin strip and in which the left and right side walls are integrally fixed with respect to each other, and one in which the opposed left and right side walls are dividable and adjustable in position relative to each other. The guide member of the first-mentioned type having the left and right side walls integrally fixed with respect to each other is replaceable with another one in accordance with the size of the sequin. In the guide member of the second-mentioned type having the dividable and adjustable the left and right side walls, on the other hand, the distance between the opposed left and right side walls is adjusted in accordance with the size of the sequin. However, these conventional guide members would present the following inconveniences. Namely, with the guide member of the second-mentioned type having the dividable and adjustable the left and right side walls, it is very cumbersome to adjust the distance between the left and right side walls in accordance with the size of the sequins; particularly, in the case where the sequin is of the type having the sewing hole offset from the center of the sequin, the adjusting operation tends to be very cumbersome because it is necessary to not only appropriately adjust the distance between the left and right side walls but also adjust the sewing hole to be located in vertical registry with the needle drop position. Further, where the sewing machine to which the guide member is applied is a multi-head sewing machine, such adjusting operation has to be performed for each and every one of the machine heads, and thus, the adjusting operation tends to be very time-consuming and lead to a very poor working efficiency. Furthermore, with the guide member of type having the left and right side walls integrally fixed with respect to each other, a plurality of the guide members corresponding to various sequin sizes have to be prepared, and thus, the necessary cost increases accordingly. Replacing the guide member of the first type with another one of the same type may be performed in a shorter time than adjusting the guide member of the second type. However, with the conventionally-known first-type guide member, it is at least necessary to appropriately adjust the fixed positions of the side walls and the replacing operation can not be performed so easily, so that relatively great amounts of time and labor would be required in actually using the guide member.

SUMMARY OF THE INVENTION

In view of the foregoing, it is an object of the present invention to provide a sequin feeder device which can appropriately feed sequins of various different sizes, shapes, etc., and which is particularly suited for feeding of a sequin having a sewing hole offset from the center of the sequin.

In order to accomplish the above-mentioned object, the present invention provides an improved sequin feeder device, which comprises: a feed mechanism for feeding a continuous sequin strip, by a predetermined pitch at a time, by movement of a feed member; a lock member having an engaging projection for engaging the continuous sequin strip to immovably lock the continuous sequin strip; and an adjustment member for adjusting engagement timing at which the engaging projection engages the continuous sequin strip during a continuous-sequin-strip feeding stroke of the feed member.

In the present invention thus arranged, the adjustment member can adjust as desired the engagement timing at which the engaging projection of the lock member engages the continuous sequin strip. Thus, the present invention can prevent the engaging projection of the lock member from sliding on the upper surface of a sequin, or minimize the distance over which the engaging projection slides on the upper surface of the sequin. As a result, it is possible to effectively prevent any unwanted sliding mark from being formed in the upper surface of the sequin. Further, even where the continuous sequin strip is of the type comprising sequins each having its sewing hole offset from the sequin center, the present invention allows the continuous sequin strip to be fed reliably because the engaging projection of the lock lever does not interfere with the feeding operation.

The present invention also provides an improved sequin feeder device, which comprises: a feed mechanism for feeding a continuous sequin strip by movement of a feed member with the continuous sequin strip set at a predetermined feed-out position; a sequin feed guide member for guiding the continuous sequin strip in such manner as to allow the continuous sequin strip to be fed straight in the predetermined feeding direction, the sequin feed guide member including a guide path corresponding to the continuous sequin strip to be fed; and a mounting member for detachably mounting the sequin feed guide member to a predetermined mounting position, the predetermined feed-out position and the guide path positionally match each other at the predetermined mounting position.

When the continuous sequin strip is to be fed, by movement of the feed member, with the sequin strip duly set at the predetermined feed-out position, the guide member in the sequin feeder device guides the continuous sequin strip to allow the continuous sequin strip to be fed straight in the predetermined feeding direction. Thus, even when there has been produced a force causing the continuous sequin strip to rotate about the neighborhood of a connecting portion between adjoining sequins of the strip, the continuous sequin strip can be reliably fed straight in the predetermined feeding direction by means of the guide member. Further, with the arrangements that the sequin feed guide member includes the guide path corresponding to the continuous sequin strip to be fed and the mounting member detachably mounts the sequin feed guide member to the predetermined mounting position and that the predetermined feed-out position and the guide path positionally match each other at the predetermined mounting position, the guide member can be readily positioned by being only fixed to the predetermined mounting position. Thus, the guide member can be attached/ detached without cumbersome adjustment of the mounting position. Therefore, the guide member is replaceable with another one, easily and in a short time, in accordance with the shape and size of the sequins of the strip.

The sequin feeder device of the present invention, equipped with the aforementioned adjustment member and/or sequin feed guide member, can appropriately deal with sequins of various types differing from one another in size, shape, etc., and the sequin feeder device of the invention is particularly suited for use in feeding of sequins having their sewing hole offset from the sequin center.

The following will describe embodiments of the present invention, but it should be appreciated that the present invention is not limited to the described embodiments and various modifications of the invention are possible without departing from the basic principles. The scope of the present invention is therefore to be determined solely by the appended claims.

Figure 7:
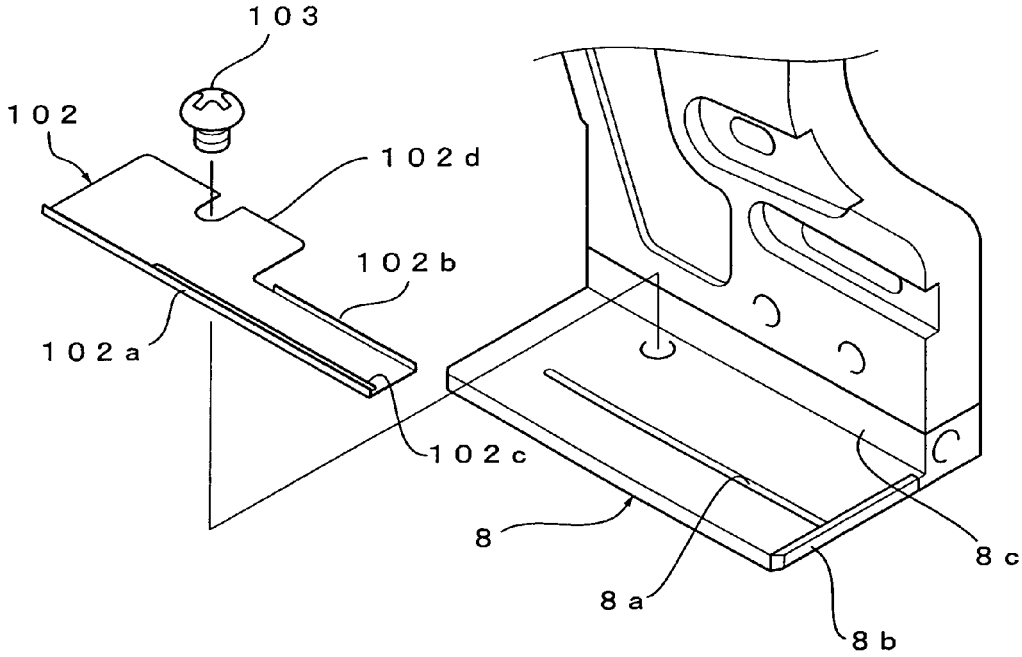
FIG. 7 is a perspective view explanatory of a sequin feed guide member provided in the embodiment of the present invention.
Figure 8:
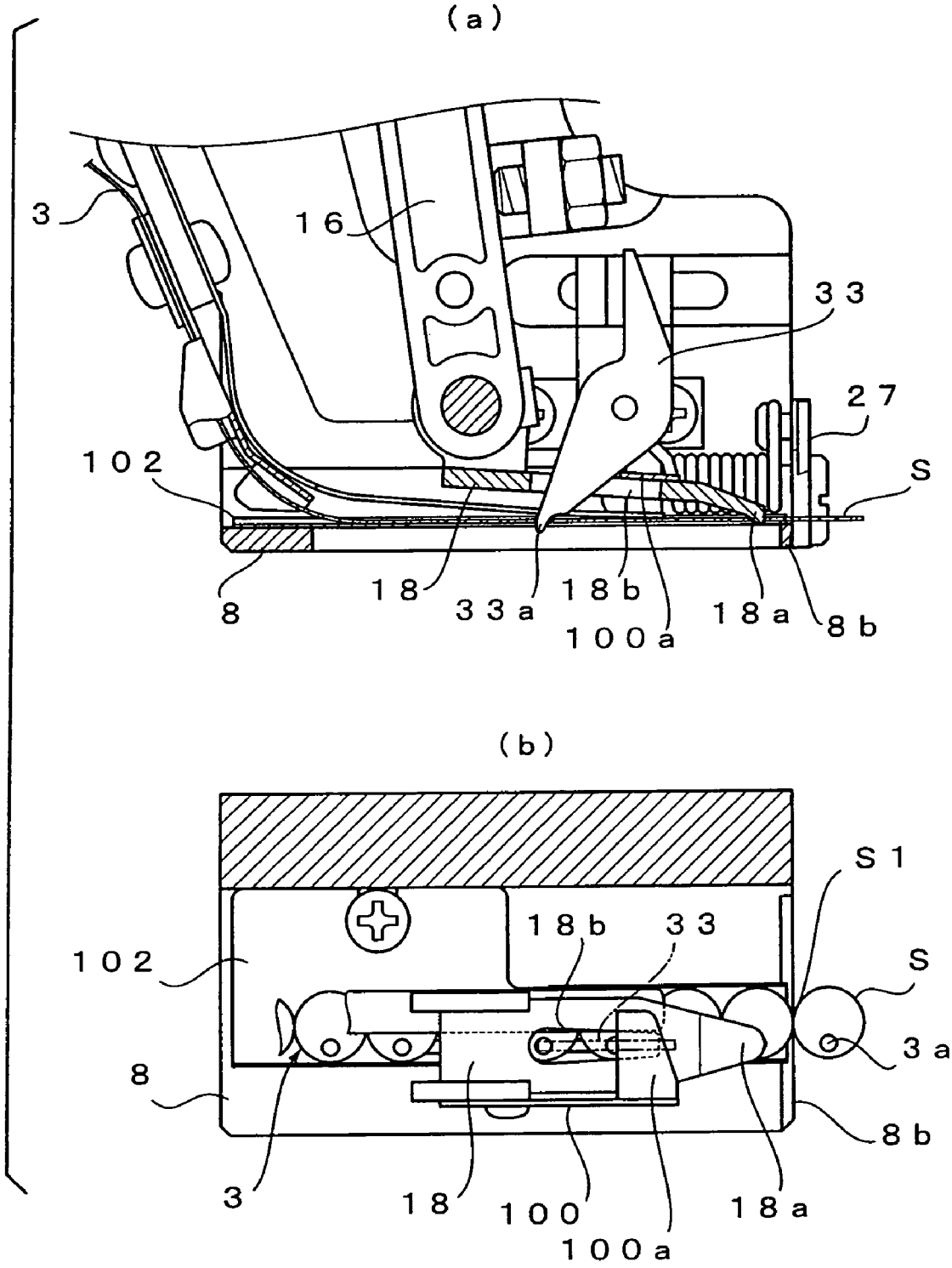
Figure 9:
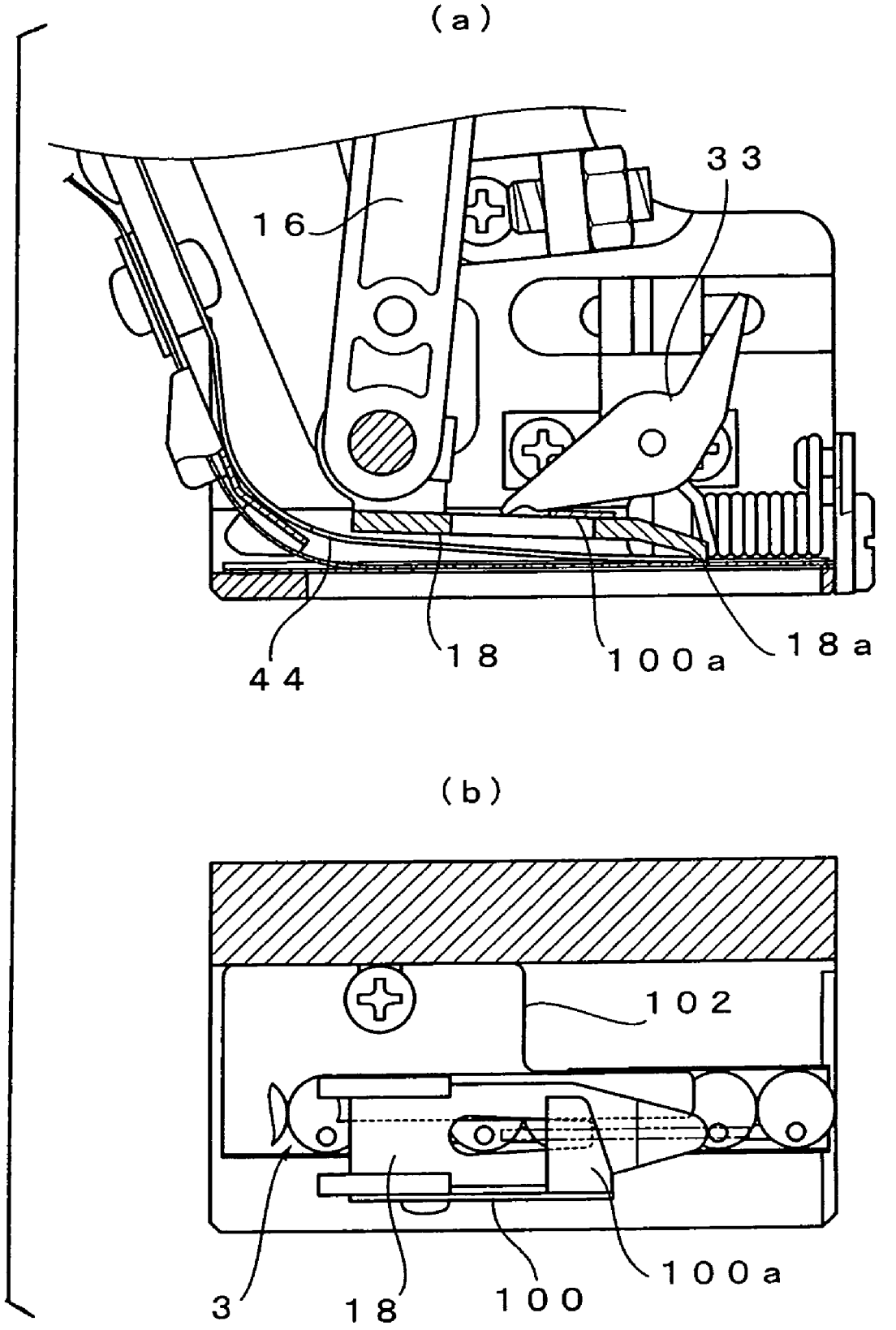
Figure 10:
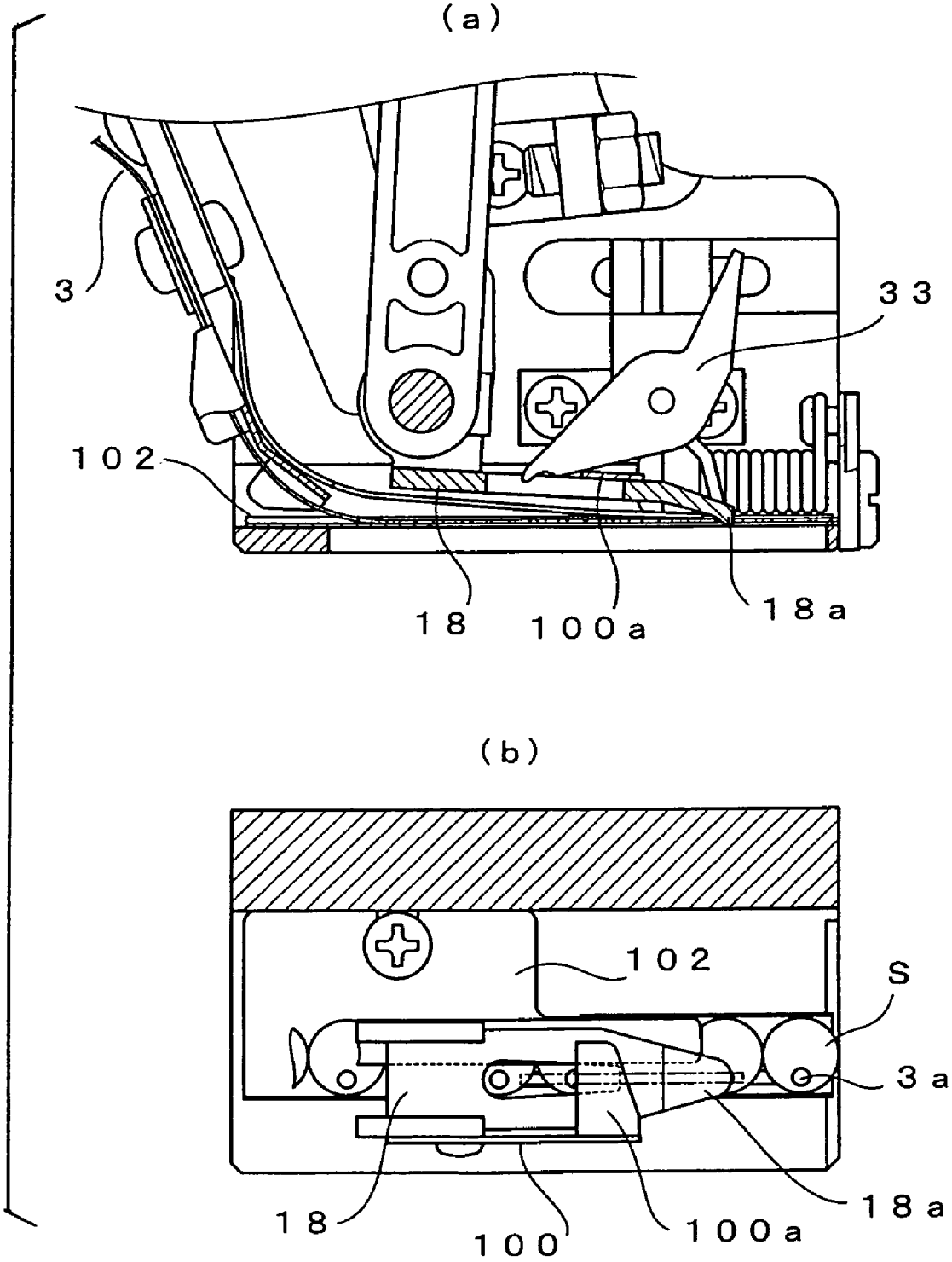
Figure 11:
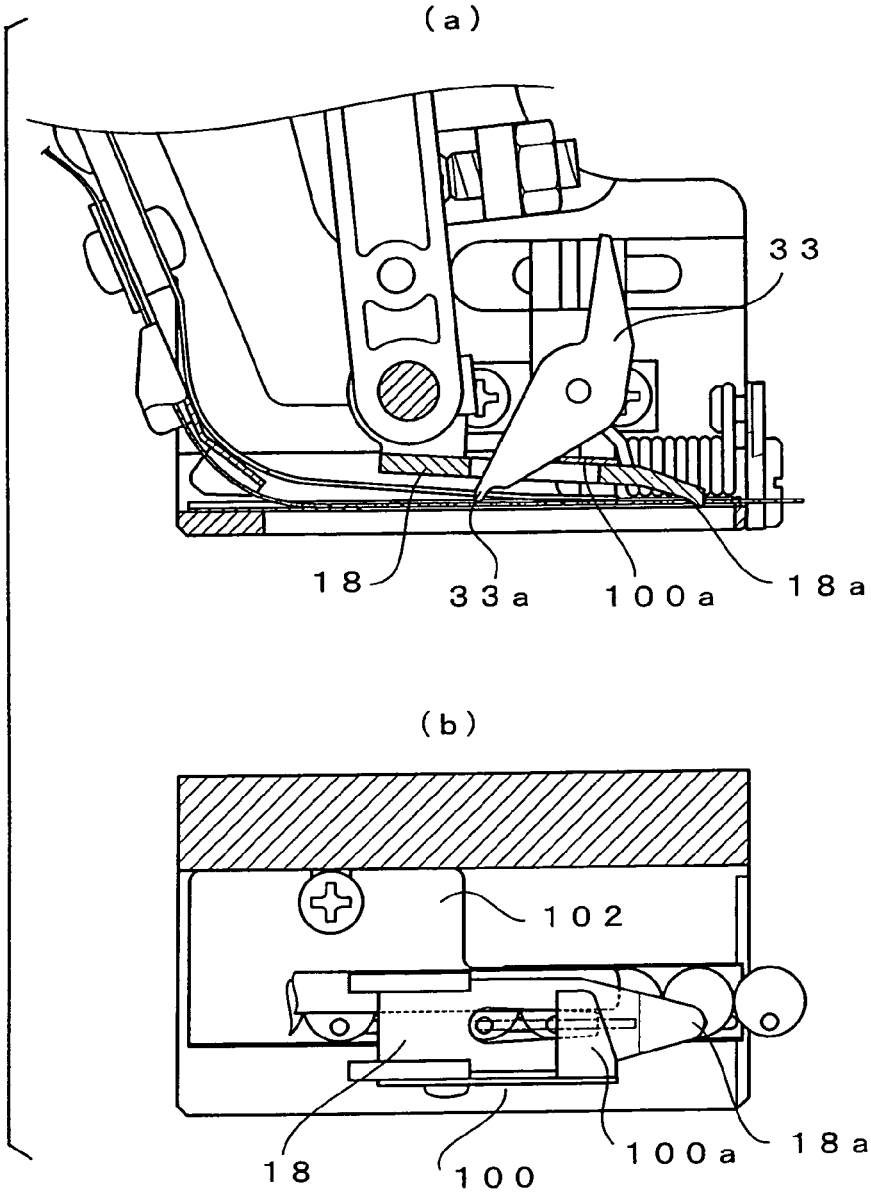
Figure 12A:
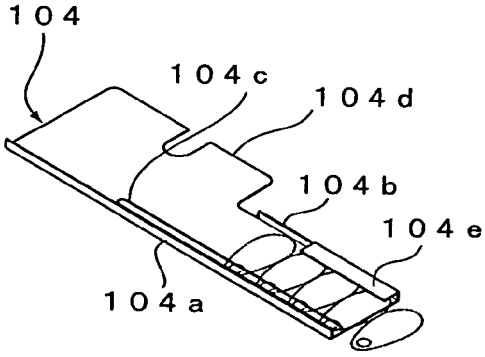
Figure 12B:
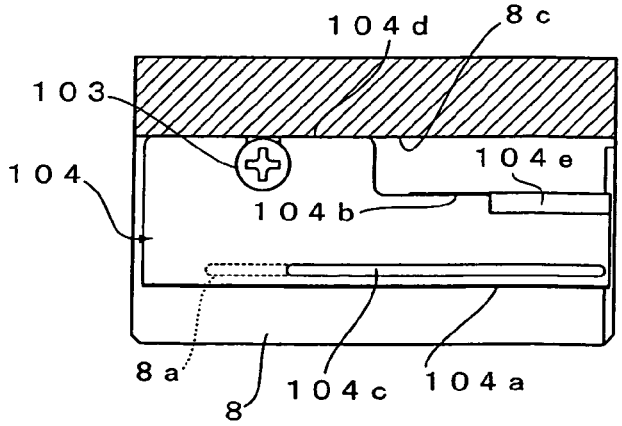
Figure 13A:
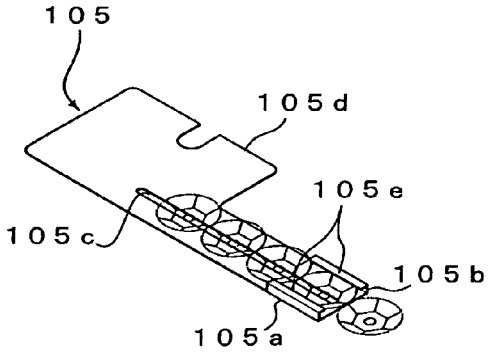
Figure 13B:
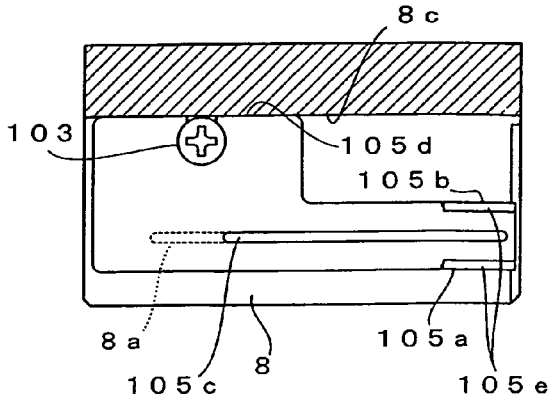
Figure 14A:
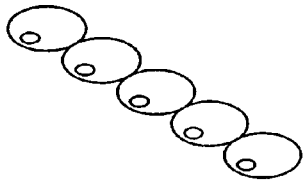
Figure 14B:
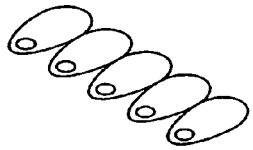
Figure 14C:
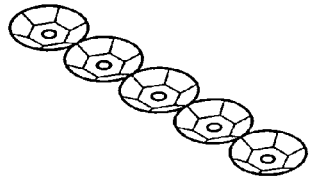

(*a*) and (*b*) of FIG. 8 are a partly-sectional side view and plan view, respectively, of the sequin feeder deice when the feed lever has moved to its forwardmost position to complete one sequin feeding cycle;

(*a*) and (*b*) of FIG. 9 are a partly-sectional side view and plan view, respectively, of the sequin feeder deice when the feed lever has moved to its rearwardmost position;

(*a*) and (*b*) of FIG. 10 are a partly-sectional side view and plan view, respectively, of the sequin feeder deice when an engaging portion of the feed lever has engaged a sewing hole of a sequin during forward movement of the feed lever;

(*a*) and (*b*) of FIG. 11 are a partly-sectional side view and plan view, respectively, of the sequin feeder deice immediately before an engaging claw of a lock lever engages a sewing hole of a sequin during the forward movement of the feed lever;

FIGS. 12A and 12B are views showing a modification of the sequin feed guide member of FIG. 7;

FIGS. 13A and 13B are views showing another modification of the sequin feed guide member of FIG. 7;

FIGS. 14A-14C are views showing various types of sequins; and

Figure 15A:
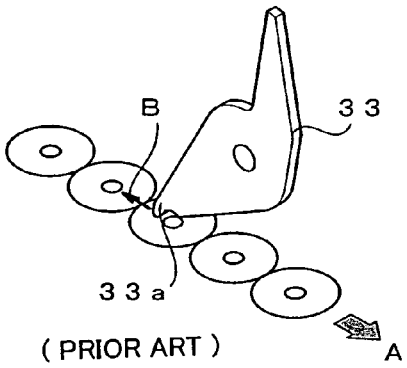
Figure 15B:
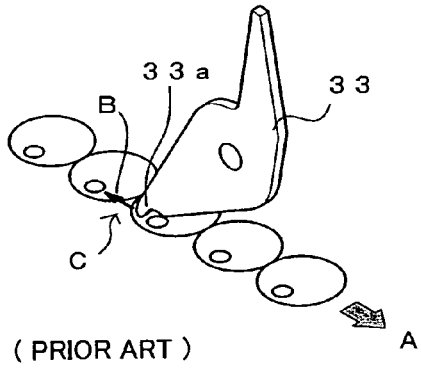

FIGS. 15A and 15B are views showing operation of a lock lever during forward movement of a feed lever in a conventionally-known sequin feeder device.

DETAILED DESCRIPTION OF THE DRAWINGS

Figure 1:
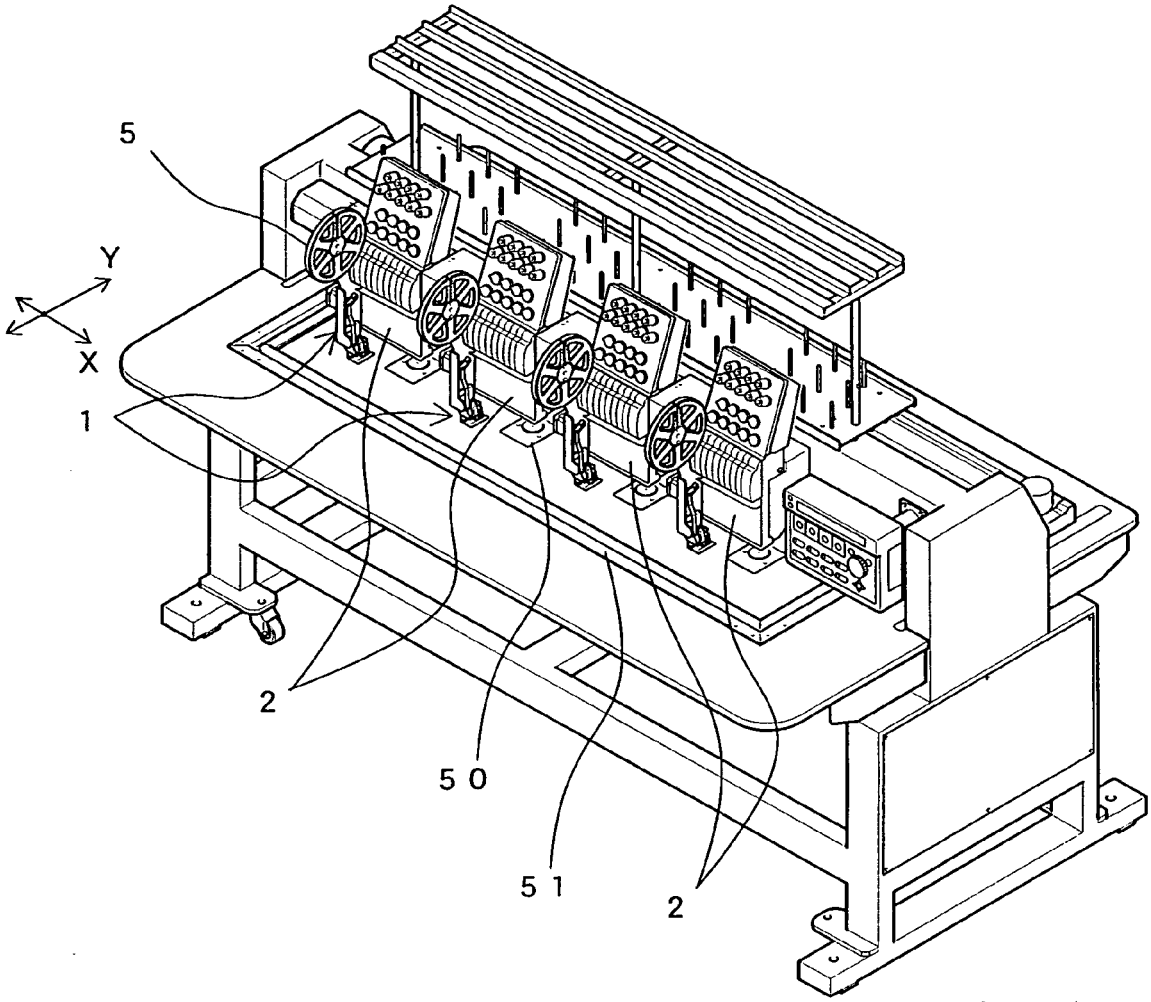
FIG. 1 is a perspective view showing a general outer appearance of an embroidery sewing machine to which is applied a sequin feeder device in accordance with an embodiment of the present invention.

FIG. 1 shows a four-head embroidery sewing machine equipped with four sewing machine heads and constructed in accordance with an embodiment of the present invention. Needle bar cases 2 are provided in corresponding relation to the sewing machine heads, and a needle plate 50 is disposed under the needle bars of each of the machine heads.

Sequin sewing unit 1 is attached to the left side and/or right side of each of the needle bar cases 2; in the instant embodiment, the sequin sewing unit 1 is attached to only the left side of the associated needle bar case 2. Each of the needle bar cases 2 comprises a multi-needle structure, and, in the case where the sequin sewing unit 1 is attached to the left side of the associated needle bar case 2 as in the illustrated example, the leftmost needle in the needle bar case 2 is used as a sequin sewing needle. As conventionally known in the art, an embroidery frame 51 is driven in left-right (X) and front-rear (Y) directions in accordance with predetermined sewing data. Each of the sequin sewing units 1 includes a reel 5 having a continuous sequin strip wound thereon.

Figure 2:
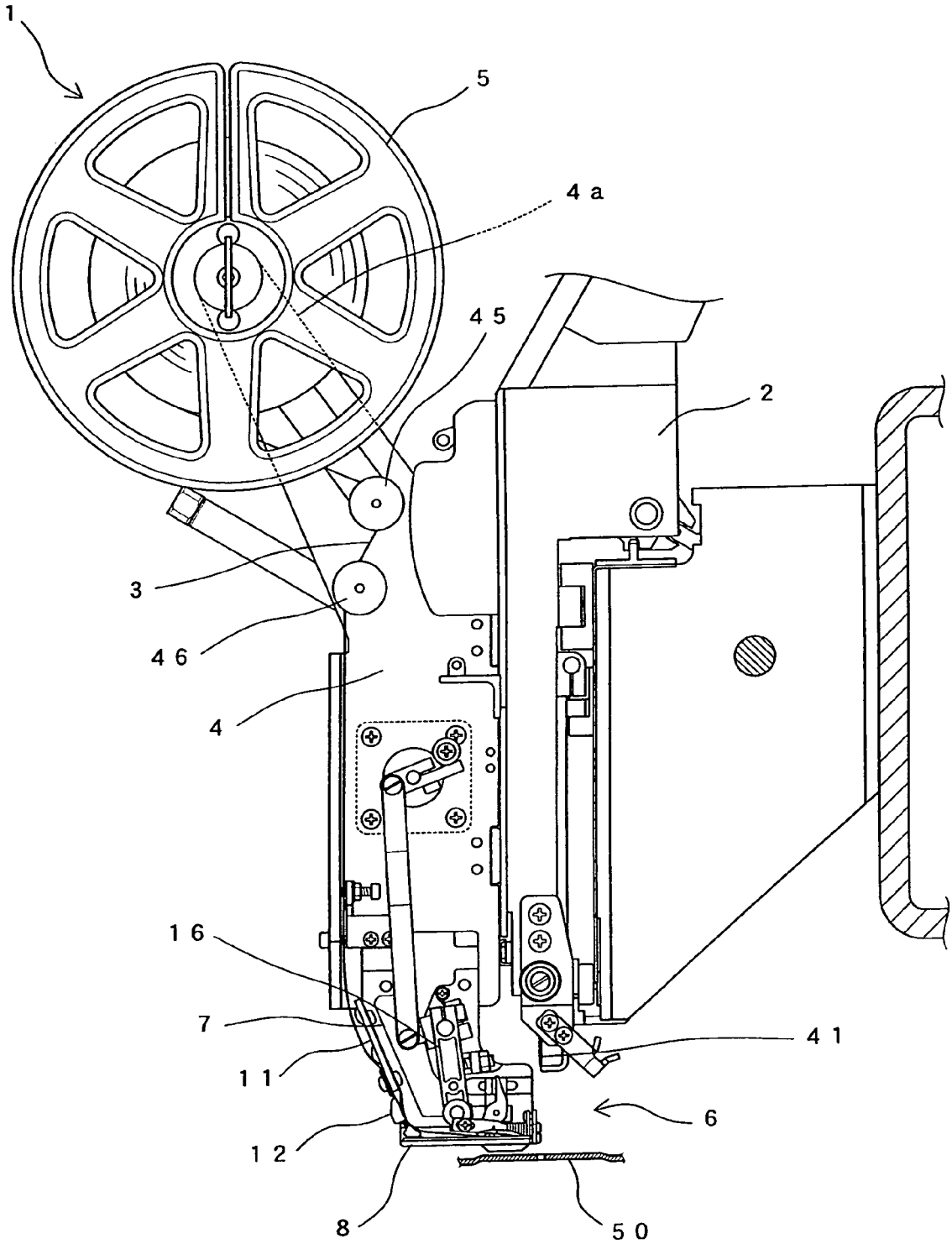
FIG. 2 is a side view showing in enlarged scale a part of one of sequin sewing units employed in the embodiment of the present invention.
Figure 3:
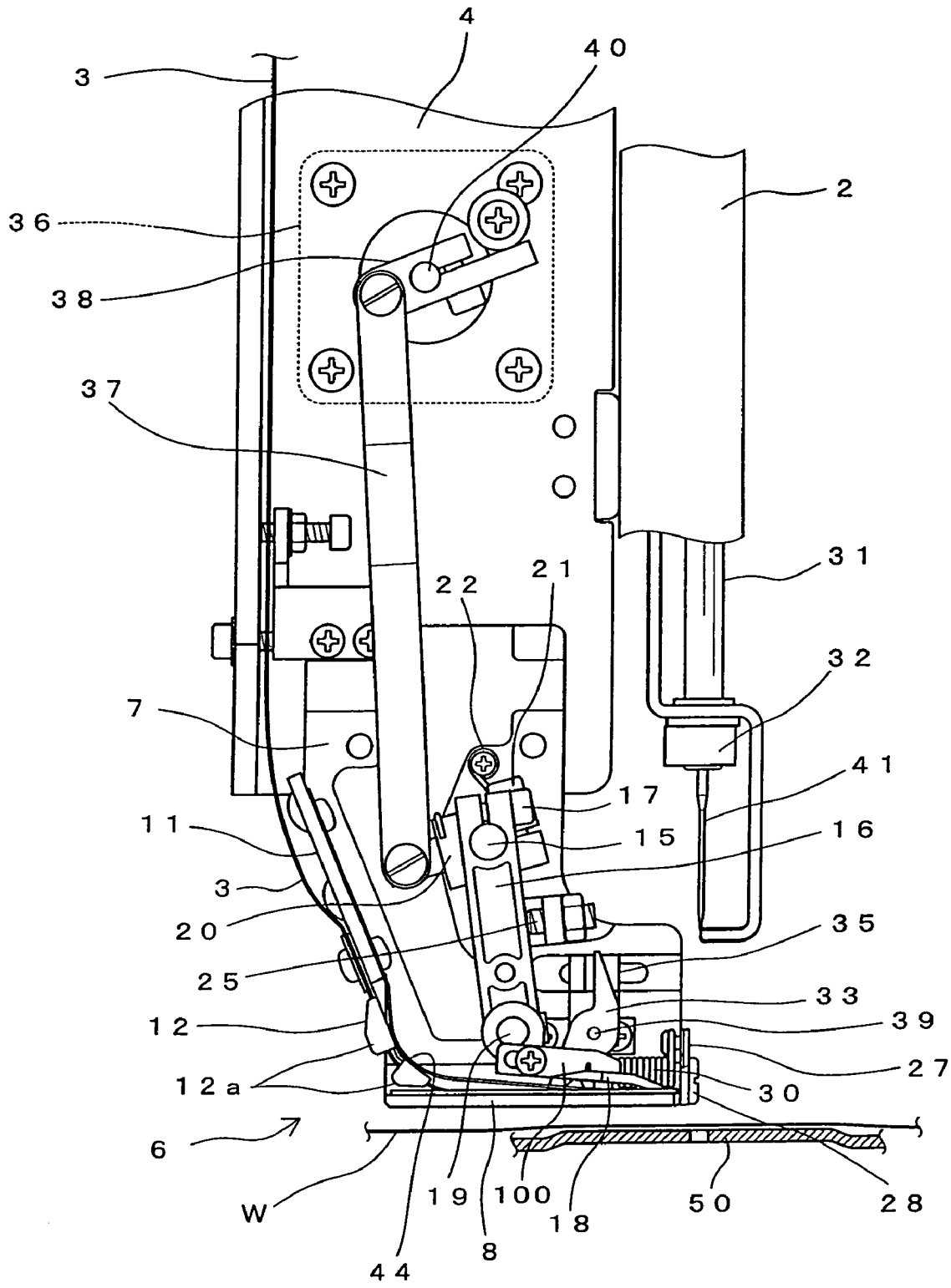
FIG. 3 is a side view showing in enlarged scale the sequin feeder device in the sequin sewing unit in the embodiment of the present invention.
Figure 4:
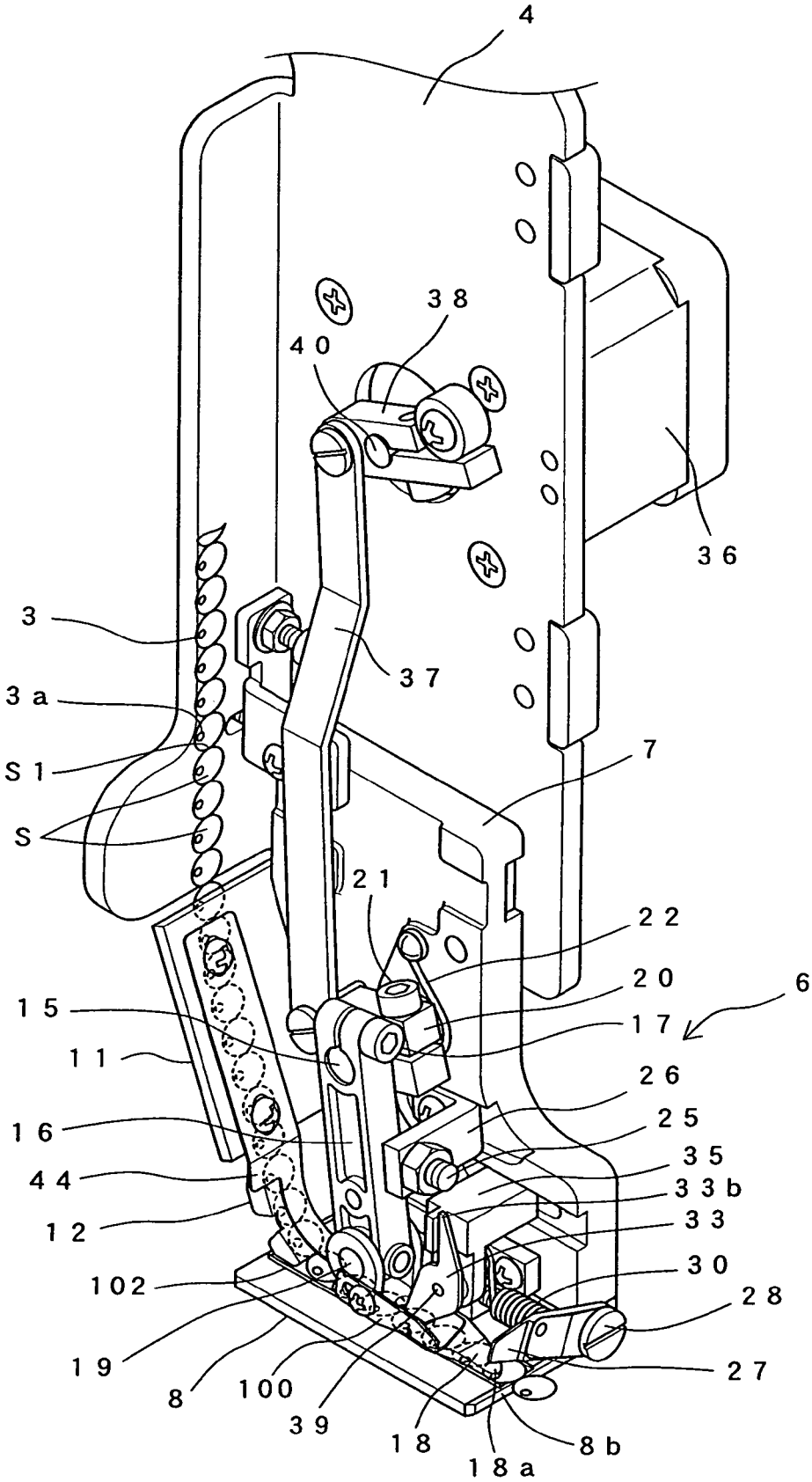
FIG. 4 is a perspective view showing part of the sequin feeder device shown in FIG. 3.
Figure 5:
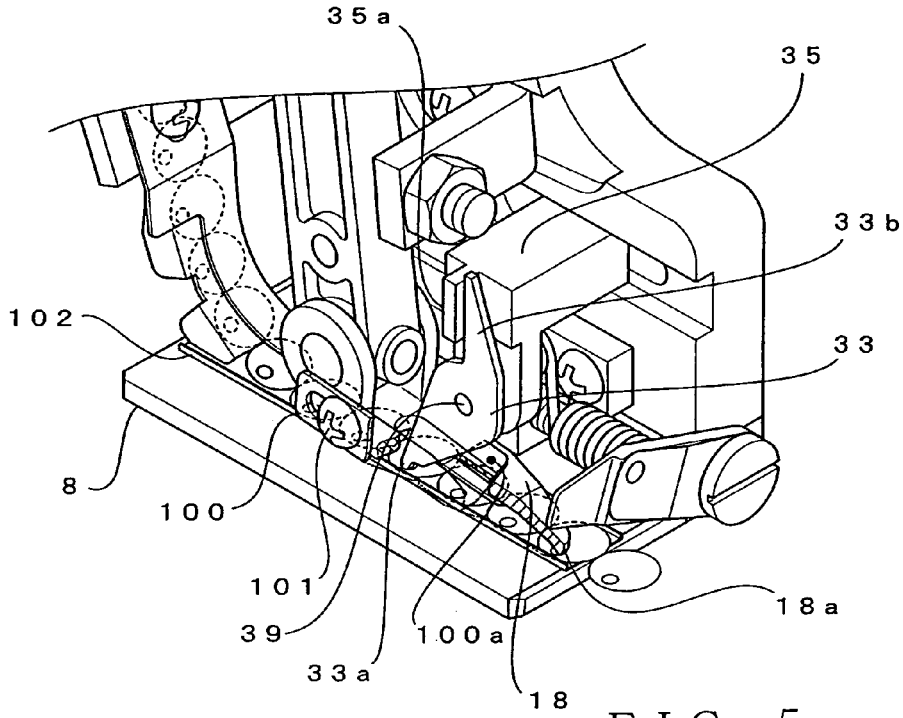
FIG. 5 is a perspective view showing in enlarged scale the relevant components of the sequin feeder device of FIG. 4 with parts taken away.

FIG. 2 is a side view showing in enlarged scale a part of one of the sequin sewing units 1, FIG. 3 is a side view showing in enlarged scale a sequin feeder device 6 employed in the sequin sewing unit 1, FIG. 4 is a perspective view showing relevant sections of the sequin feeder device 6, and FIG. 5 is a perspective view showing in enlarged scale relevant components of the sequin feeder device 6 with parts taken away.

As illustrated in FIG. 2, the sequin sewing unit 1 also includes a mounting base 4, on which are supported the reel 5 having a continuous sequin strip 3 wound thereon and the sequin feeder device 6. The mounting base 4 is mounted via a not-shown link mechanism in such a manner that it can ascend and descend relative to the needle bar case 2. In FIGS. 2 and 3, the mounting base 4 is shown as being in a descended position and in a posture to permit sewing of sequins. On the other hand, when sewing of sequins is not to be performed, the mounting base 4 is evacuated to an ascended position so as not to hinder the normal embroidering operation. In the individual machine heads, the mounting bases 4 are driven to ascend or descend concurrently via not-shown air cylinders. Where the embroidery sewing machine has a smaller number of the machine heads as in a single-head embroidery sewing machine, the mounting base (or bases) 4 may be caused to ascend or descend through manual operation by a human operator.

The reel 5 having the continuous sequin strip 3 wound thereon is rotatably and removably attached to an upper end portion of an arm section 4*a* (see FIG. 2) formed on an upper portion of the mounting base 4. The continuous sequin strip 3 is let out or played out from the reel 5 to the sequin feeder device 6. The continuous sequin strip 3 is formed, for example, by die-cutting a synthetic resin film of a given width into a configuration having a multiplicity of generally circular sequins S continuously connected via connecting portions S1 (see FIG. 4). In the instant embodiment, the continuous sequin strip 3 is a strip of continuously-connected sequins S each having a sewing hole (needle passing hole) 3*a* offset from center of the sequin in a direction perpendicular to the sequin feeding direction as illustrated in FIG. 14A.

Next, an example construction of the sequin feeder device 6 will be explained in detail.

The sequin feeder device 6 is secured to a supporting plate 7 that is in turn attached to a lower end portion of the mounting base 4. The supporting plate 7 has a horizontal sequin support plate 8 formed on its lower end for supporting thereon sequins. Portion of the continuous sequin strip 3, paid out or let out from the reel 5, is directed downward along the mounting base 4 via a tension roller 45 and orientation roller 46 (FIG. 2), led onto the support plate 8 by way of a guide section 12 (see FIGS. 2 and 3) provided on the rear surface of a bracket 11 and then delivered rearward as viewed from the front of the embroidery sewing machine. Note that, in the following description about the sequin sewing unit 1, the terms "forward" and "reward" are used to refer to directions opposite to the forward and rearward directions of the embroidery sewing machine, for convenience of explanation. Namely, the direction in which sequins are fed out (i.e., in a rearward direction as viewed from the front of the embroidery machine, or rightward in FIG. 2) will hereinafter referred to as "forward direction".

The support plate 8 has a slit 8*a* (see FIG. 7) having an appropriate width and a predetermined length along the sequin feeding direction (i.e., in the front-to-rear direction), and the slit 8*a* is provided to allow an engaging portion 18*a* provided ay the distal end of a later-described feed lever 18 and an engaging claw 33*a* of a later-described lock lever 33 (see FIG. 5) to bite into predetermined sequins S. The guide section 12 is provided in such a manner that its position in the left-right direction is adjustable to allow the sewing holes 3*a* of predetermined ones of the sequins S of the continuous sequin strip 3, led onto the support plate 8, to be positioned in vertical alignment or registry with the slit 8*a*. The guide section 12 comprises two guide members 12*a*, each of which may be made by bending a plate into a channel-like sectional shape. The guide section 12 is replaceable with another one depending on the width of the continuous sequin strip 3 set on the sequin feeder device 6. Holding member 44 is mounted to the front surface of the bracket 11 having the guide section 12 attached thereto. The holding member 44 is in the form of a resilient plate, such as a spring steel plate, which has a width equal to or slightly greater than the width of the sequin S and has a predetermined length. The holding member 44 has one end portion secured to the bracket 11 and the other end portion resiliently abutted against the upper surface of the support plate 8 with an intermediate portion of the holding member 44 bent arcuately. The continuous sequin strip 3, which is delivered via the guide section 12 onto the support plate 8, is passed between the support plate 8 and the holding member 44 resiliently abutted against the upper surface of the support plate 8.

As illustrated in FIG. 3, a pivot shaft 15 is pivotally supported on a middle portion of the supporting plate 7 with the axial centerline of the pivot shaft 15 extending in the left-right direction (i.e., X direction in FIG. 1). Pivot lever 16 is fixed via a screw 17 to the pivot shaft 15. Further, a follower lever 20 is fixed via a screw 21 to the pivot shaft 15. Consequently, the follower lever 20 and pivot lever 16 are integrally connected together to provide a "bellerank-like" structure. Torsion spring 22 fitted around the pivot shaft 15 has one end secured to the supporting plate 7 and the other end held on the follower lever 20, so that the pivot lever 16 is normally biased in a counterclockwise direction of FIG. 3, by the biasing force of the torsion spring 22. The pivot lever 16, normally biased in the counterclockwise direction via the torsion spring 22, is held in a posture as illustrated in FIGS. 2-5 by abutting against a stopper 25 provided on the supporting plate 7. The stopper 25 is in the form of a threaded rod screwed to a bracket 26 secured to the supporting plate 7, and the stopper 25 is locked by screwing up of a nut. The pivot lever 16 abuts against the rear end of the stopper 25. The posture of the pivot lever 16 shown in FIGS. 2-5 is taken when operation for feeding out one sequin has been completed as will be later described. When the operation for feeding out one sequin (i.e., one feeding cycle) has been completed, a connecting portion between the first or leading sequin and the second sequin from the leading end of the continuous sequin strip is located in vertical registry with the cutting edge of a fixed cutter blade 8*b* formed at the front end edge of the support plate 8. Movable cutter blade 27 is pivotably supported via a pin 28 on a lower end portion of the supporting plate 7 and is normally held, via a torsion spring 30, in a retracted or evacuated posture or position spaced upward from the fixed cutter blade 8*b*. The movable cutter blade 27 is depressed by a needle clamp 32, provided at the lower end of the needle bar 31, as the needle bar 31 descends. The depression by the needle clamp 32 causes the movable cutter blade 27 to pivot downward against the resilient biasing force of the torsion spring 30, so that the movable cutter blade 27 can cut the strip 3 across the connecting portion S1 of between the sequins S in conjunction with the fixed cutter blade 8*b*. As the needle clamp 32 ascends together with the needle bar 31, the movable cutter blade 27 returns to its retraced position by the restoring or resilient force of the torsion spring 30.

The feed lever 18 is pivotably supported, via a shaft 19, on a free end portion of the pivot lever 16. Torsion spring (not shown) is fitted around the shaft 19 and has one end secured to the pivot lever 16 and the other end held on the feed lever 18. By the not-shown torsion spring, the feed lever 18 is normally biased in the clockwise direction about the shaft 19 in such a manner that its distal end is normally biased toward the support plate 8.

Further, the feed lever 18 has, at its distal end, the engaging portion 18*a*, which functions to feed the continuous sequin strip 3 in the forward direction at a predetermined pitch by being moved forward with the engaging portion 18*a* getting into and engaging the sewing hole 3*a* of a predetermined one of the sequins S of the sequin strip 3 placed on the support plate 8. As will be later detailed, the feed lever 18 is moved forward and rearward in response to pivotal movement of the pivot lever 16, so as to sequentially feed the continuous sequin strip 3 forward by the predetermined pitch at a time. The pivot lever 16 and mechanism for pivoting the pivot lever 16 together constitute a feed mechanism for moving the feed lever 18 in the forward and rearward directions. The above-mentioned follower lever 20 integrally connected with the pivot lever 16 has a free end connected to a free end of a driving lever 38 via a connection link 37. The driving lever 38 is fixedly connected to an output shaft 40 of a motor 36 that is in turn secured to a left side surface of the mounting base 4. By the motor 36 driving the driving lever 38 to reciprocatively pivot through a predetermined angular range, the pivot lever 16 is caused to pivot via the connection link 37 and follower lever 20, and the feed lever 18 is driven to move forward and rearward, in response to the pivoting movement of the pivot lever 16, so that the continuous sequin strip 3 can be fed forward in a predetermined manner.

Figure 6:
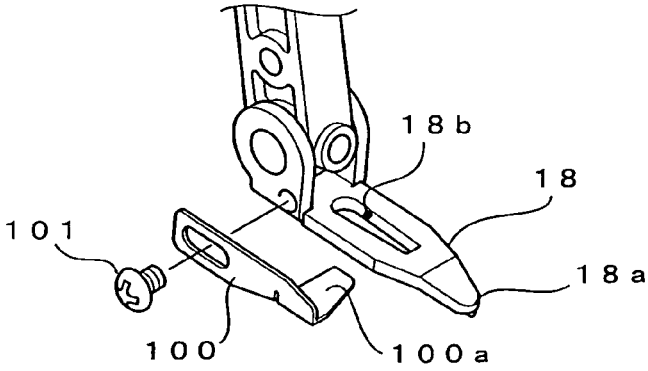
FIG. 6 is a perspective view explanatory of an adjustment member in the embodiment of the present invention.

As shown in FIGS. 4 and 5, the feed lever 18 has an adjustment member 100 mounted thereon as a means for adjusting engagement timing at which the later-described engaging claw engages a predetermined one of the sequins during the feeding stroke, by the feed lever 18, of the continuous sequin strip 3. FIG. 6 is a perspective view showing how the adjustment member 100 is mounted to the feed lever 18. As shown in the figure, the adjustment member 100 is mounted to the feed lever 18 by means of a screw 101 inserted through a mounting hole that is elongated in shape along the operating direction of the feed lever 18, and the adjustment member 100 as a whole extends along the operating direction of the feed lever 18 and has an adjustment piece 100*a* at its one end. With the adjustment member 100 mounted on the feed lever 18, the adjustment piece 100*a* extends across a through-hole 18*b* of the feed lever 18 to cover part of the through-hole 18*b*. Further, because the mounting hole for mounting the adjustment piece 100*a* to the feed lever 18 is elongated along the operating direction of the feed lever 18, the adjustment piece 100*a* is adjustable in position relative to the feed lever 18 within a limited range determined by the length of the mounting hole. By adjusting the position of the adjustment member 100 relative to the feed lever 18, it is possible to adjust the position of the adjustment piece 100*a* relative to the feed lever 18.

Because the adjustment piece 100*a* can function as an abutment portion for the later-described lock lever 33, it is possible to control movement of the lock lever 33 in accordance with the mounted position of the adjustment piece 100*a* and thereby set as desired the engagement timing at which the end (engaging claw) of the lock lever 33 engages the predetermined sequin, as will be later described in relation to the sequin feeding operation.

As shown in FIG. 5, a sequin feed guide member 102 is disposed on the upper surface of the support plate 8, and the sequin feed guide member 102 functions as a means for guiding the continuous sequin strip 3 so that the continuous sequin strip 3 led onto the support plate 8 is fed straight in the predetermined feeding direction by the feeding operation of the feed lever 18. FIG. 7 is a perspective view explanatory of how the sequin feed guide member 102 is mounted to the support plate 8, which particularly shows the support plate 8 and sequin feed guide member 102 as viewed obliquely from above. The sequin feed guide member 102 is fixed to the support plate 8 by means of a screw 103 and includes a pair of opposed guide walls 102*a* and 102*b* for guiding the left and right side edges of the sequins S of the continuous sequin strip 3. Distance between the opposed guide walls 102*a* and 102*b* is set slightly greater than the width of each sequin S of the sequin strip 3. The continuous sequin strip 3 can be guided to be fed straight in the predetermined feeding direction by being passed between the guide walls 102*a* and 102*b*.

The sequin feed guide member 102 has a slit 102*c* of a predetermined length formed therein and extending in the front-rear direction in positional correspondence with the slit 8*a* of the support plate 8. The sewing holes 3*a* of predetermined ones the sequins S of the continuous sequin strip 3, led between the guide walls 102*a* and 102*b*, are positioned in vertical registry with the slit 102*c* of the sequin feed guide member 102. The slit 102*c* is provided to allow the respective distal ends of the engaging portion 18*a* of the feed lever 18 and engaging claw 33*a* of the lock lever 33 (see FIG. 5) to bite into the sewing holes 3*a* of the predetermined sequins S as the engaging portion 18*a* and engaging claw 33*a* engage the sewing holes 3*a*. The sequin feed guide member 102 is fixed in place with the slit 102*c* positioned in vertical registry with the slit 8*a* of the support plate 8, because the sequin feeding operation can not be carried out properly unless the engaging portion 18*a* of the feed lever 18 and engaging claw 33*a* of the lock lever 33 appropriately fit into the two slits 102*c* and 8*a*.

The sequin feed guide member 102 is constructed so that the slit 102*c* can be positioned in vertical registry with the slit 8*a* of the support plate 8 only if the sequin feed guide member 102 is fixed to the support plate 8 with its inner side edge 102*d* abutted against a side wall 8*c* of the support plate 8. Therefore, this sequin feed guide member 102 can be appropriately positioned by the human operator just abutting the inner side edge 102*d* against the side wall 8*c* of the support plate 8. Further, because the sequin feed guide member 102 can be fixed to the support plate 8 with only one screw 103, the operation necessary for fixing the sequin feed guide member 102 is greatly facilitated.

In the instant embodiment, the distance between the guide walls 102*a* and 102*b* is invariable, and thus, when the sequins to be sewn have been switched over to sequins differing in size from the previous sequins, the sequin feed guide member 102 has to be replaced with another sequin feed guide member 102 where the distance between the guide walls 102*a* and 102*b* corresponds to the size of the changed (i.e., newly-set) sequin. In such a case too well, the replacement of the sequin feed guide member 102 can be carried out with utmost ease because the instant embodiment allows the guide members 102 to be detached and attached very easily.

In the instant embodiment, one of the guide walls (in the illustrated example of FIG. 7, outer guide wall 102*a*) is formed up to a rearmost portion of the sequin feed guide member 102. However, the one or outer guide wall 102*a* may be formed to have the same length as the other or inner guide wall 102*b*. Alternatively, the other or inner guide wall 102*b* may be formed into a smaller length as long as the continuous sequin strip 3 can be fed straight in the predetermined feeding direction via the guide walls 102*a* and 102*b*. Namely, the lengths of the guide walls 102*a* and 102*b* are not limited to those in the illustrated example and may be chosen as desired as long as the continuous sequin strip 3 can be fed straight in the predetermined feeding direction.

Next, a description will be given about the lock lever 33 and a mechanism for driving the lock lever 33.

As seen in FIGS. 3, 4 and 5, the lock lever 33 has the engaging claw 33*a* at its one end and a stopper portion 33*b* at its other end. Intermediate portion of the lock lever 33 is pivotably supported, via a pin 39, by a support block 35 that is in turn fixed to the supporting plate 7. In FIG. 5, the feed lever 18 and adjustment member 100 are shown with their front portions taken away to allow the lock lever 33 to be more readily visible. Also, in FIG. 5, the engaging claw 33*a* of the lock lever 33 is inserted through the through-hole 18*b* formed in the feed lever 18. The adjustment piece 100*a* of the adjustment member 100, positioned to cover part of the through-hole 18*b*, is located forwardly of the engaging claw 33*a*, inserted through the through-hole 18*b*, as viewed in the sequin feeding direction. Namely, the adjustment piece 100*a* functions to adjust the size (i.e., length in the sequin feeding direction) of the through-hole 18*b* relative to the engaging claw 33*a*.

Torsion spring (not shown) is provided on the pin 39 fixed to the support block 35, and the lock lever 33 is normally biased, by that torsion spring, against the support block 35 in the counterclockwise direction of the figure. When the lock lever 33 is in its free state, the biasing force of the not shown torsion spring causes the stopper portion 33*b* to abut against a stopper portion 35*a* of the support block 35, and thus, the lock lever 33 is held in a posture or position where the end of the engaging claw 33*a* faces the slit 8*a* of the support plate 8. In this posture, the engaging claw 33*a* of the lock lever 33 engages the sewing hole 3*a* of one of the sequins S of the strip 3 led onto the support plate 8 to thereby immovably lock the continuous sequin strip 3. As the feed lever 18 moves rearward or retracts from the position of FIG. 5, the adjustment piece 100*a* of the adjustment member 100, fixed to the feed lever 18, abuts against the lock lever 33. Thus, the lock lever 33 is pushed rearward by the retracting movement of the feed lever 18, so that it pivots in the clockwise direction against the counterclockwise biasing force of the not-shown torsion spring. As the lock lever 33 thus pivots in the clockwise direction, the engaging claw 33*a* moves upward away from the sequin, which releases the engagement of the sewing hole 3*a* of the sequin S by the engaging claw 33*a*. Namely, the lock lever 3 is driven to pivot, by the counterclockwise biasing force of the not-shown torsion spring and the clockwise driving force of the retracting feed lever 18.

The support block 35 supporting the lock lever 33 is adjustable in its position, in the front-rear direction (i.e., feeding direction of the continuous sequin strip 3 on the support plate 8), relative to the supporting plate 7. Thus, the position at which the engaging claw 33*a* of the lock lever 33 engages the sequin S is adjustable in accordance with the size of the sequin S. The supporting plate 7 too is adjustable in its position, in the front-rear direction (i.e., feeding direction of the continuous sequin strip 3 on the support plate 8), relative to the mounting base 4.

The following paragraphs describe the sequin feeding operation performed in the embodiment of the present invention, with primary reference to FIGS. 8-11 showing an example sequence of the sequin feeding operation. In each of FIGS. 8-11, section (a) is a partly-sectional side view of the sequin feed mechanism showing various states or phases of the sequin feeding operation, while section (b) is a schematic plan view showing the phases of the sequin feeding operation.

FIG. 8 shows a state when one sequin feeding operation cycle has been completed, i.e. when one of sequins S of a continuous sequin strip 3 has been fed through one sequin feeding operation cycle. In this state, the first or leading sequin S of the continuous sequin strip 3 projects forward from the support plate 8, and the connecting portion S1 between the leading sequin S and the second sequin S is positioned in vertical registry with the cutting edge of the fixed cutter blade 8*b* formed at the front end edge of the support plate 8. Also, in this state, the engaging portion 18*a* of the feed lever 18 engages the sewing hole 3*a* of the second sequin S from the leading end of the continuous sequin strip 3, and the engaging claw 33*a* of the lock lever 33 engages the sewing hole 3*a* of the fifth sequin S from the leading end of the continuous sequin strip 3 (i.e., third sequin from the above-mentioned second sequin). As apparent from (b) of FIG. 8, the adjustment piece 100*a* of the adjustment member 100 covers a front area (right area in the figure) of the through-hole 18*b* of the feed lever 18 and thereby reduces the size (i.e., length in the sequin feeding direction) of the through-hole 18*b*. The mounted position of the adjustment member 100 is adjusted in advance so that the adjustment piece 100*a* is located slightly forwardly of the lock lever 33 when one sequin feeding operation cycle has been completed.

In this state, the sequin sewing operation is carried out in the following sequence as the needle bar 31 (see FIG. 3) descends. First, a sewing needle 41 provided at the lower end of the needle bar 31 fits into the sewing hole 3*a* of the leading sequin S of the sequin strip 3. Then, the lower end of the needle clamp 32 abuts against the upper end of the movable cutter 27 and thereby depresses the movable cutter blade 27, so that the sequin strip 3 is cut in the connecting portion S1 between the leading sequin and the second sequin through the cooperative cutting operation of the movable and fixed cutter blades 27 and 8*b*, and thus is the leading sequin S is severed from the sequin strip 3. Then, the thus-severed sequin S falls onto an embroidering (i.e., to-be-embroidered) cloth or fabric W (FIG. 3) with the sewing needle 41 still kept fit in the sewing hole 3*a*, after which the sequin S is sewn onto the embroidering fabric W through controlled movement of the embroidery frame holding the embroidering fabric W and vertical movement of the needle bar 31.

Then, the pivot lever 16 is pivoted in the clockwise direction via the motor 36, so that the feed lever 18 moves rearward (leftward in (a) of FIG. 8). As the feed lever 18 retracts, the rear edge of the adjustment piece 100*a* of the adjustment member 100, fixed to the feed lever 18, abuts against the lock lever 33 inserted through the through-hole 18*b*, to thereby cause the lock lever 33 to pivot in the clockwise direction against the biasing force of the not-shown torsion spring. By such pivoting movement of the lock lever 33, the engaging claw 33*a* of the lock lever 33 moves upward away from the sequin S, and thus, the engagement, by the engaging claw of the lock lever, of the sewing hole of the sequin is released.

Timing at which the lock lever 33 starts pivoting in the clockwise direction in response to the retracting movement of the feed lever 18 depends on the positional relationship between the adjustment piece 100*a* of the adjustment member 100 and the lock lever 33, i.e. spaced-apart distance between the adjustment piece 100*a* and the lock lever 33 in the state of FIG. 8. Namely, the smaller the spaced-apart distance between the adjustment piece 100*a* and the lock lever 33, the earlier the lock lever 33 starts pivoting in response to the retracting movement of the feed lever 18, while, the greater the spaced-apart distance, the later the lock lever 33 starts pivoting in response to the retracting movement of the feed lever 18.

FIG. 9 shows the feed lever 18 having retracted to its rearwardmost position. During the retracting movement of the feed lever 18 from the position of FIG. 8 to the position of FIG. 9, the engaging portion 18*a* of the feed lever 18 gets out of the sewing hole 3*a* of the sequin S, and the feed lever 18 moves rearward relative to the continuous sequin strip 3. Although the feed lever 18 moves rearward with the engagement, by the engaging claw 33*a* of the lock lever 33, of the sewing hole 3*a* of the sequin S released, the resilient force of the holding member 44 effectively prevents the continuous sequin strip 3 from retracting together with the retracting feed lever 18.

Because the engaging claw 33*a* of the lock lever 33 is still kept in engagement with the sewing hole 3*a* when the engaging portion 18*a* of the feed lever 18 gets out of the sewing hole 3*a* of the sequin S, the continuous sequin strip 3 can be effectively prevented from moving as the engaging portion 18*a* of the feed lever 18 gets out of the sewing hole 3*a*. Therefore, the pivot timing of the lock lever 33 may be adjusted in such a manner that, at least until the engaging portion 18*a* completely gets out of the sewing hole 3*a*, the adjustment piece 100*a* of the adjust member 100 and the lock lever 33 is left spaced apart so that the lock lever 33 is not caused to pivot.

After that, the pivot lever 16 is driven, by the reverse rotation of the motor 36 (see FIGS. 3 and 4), to pivot in the counterclockwise direction, so that the feed lever 18 moves forward up to the position shown in FIG. 8. FIGS. 10 and 11 show variation in operational state of the feed lever 18 during such forward movement.

First, FIG. 10 shows the feed lever 18 at a time point when the engaging portion 18*a* has engaged the sewing hole 3*a* of the sequin S through the forward movement of the feed lever 18. Then, feeding of the continuous sequin strip 3 is carried out by further forward movement of the feed lever 18. In the state of FIG. 10, the adjustment piece 100*a* of the adjust member 100 is kept abutting against the lock lever 33 although the lock lever 33 is normally biased, via the torsion spring, in the counterclockwise direction, as noted above, so that the lock lever 33 is prevented from pivoting by the biasing force of the torsion spring. However, as the feed lever 18 moves forward, the relative position of the adjustment piece 100*a* to the lock lever 33 varies in the sequin feeding direction, in response to which the lock lever 33 also pivots in the counterclockwise direction (i.e., the sequin feeding direction) so that the engaging claw 33*a* descends toward a predetermined sequin S. FIG. 11 shows a state immediately before the engaging claw 33*a* of the lock lever 33 engages the sewing hole 3*a* of the sequin S, at which time the adjustment piece 100*a* of the adjust member 100 is still kept in abutment against the lock lever 33. As the feed lever 18 further moves forward from the position of FIG. 11, the adjustment piece 100*a* disengages from the lock lever 33, so that the lock lever 33 is brought into the free state immediately before it reaches the feed-out completing posture shown in FIG. 8. Then, once the lock lever 33 reaches the feed-out completing posture, the engaging claw 33*a* of the lock lever 33 completely engages the sewing hole 3*a* of the sequin S by the biasing force of the above-mentioned torsion spring.

Namely, the timing at which the lock lever 33 disengages from the adjustment piece 100*a* to be brought into the free state, during the forward movement of the feed lever 18, i.e. the timing at which the engaging claw 33*a* of the lock lever 33 engages the sewing hole 3*a* of the sequin S, in response to variation in the position of the adjustment piece 100*a* of the adjustment member 100 relative to the lock lever 33 can be adjusted to coincide with or to be immediately before the sequin feed-out completion time. Thus, the instant embodiment can completely prevent the engaging claw 33*a* from sliding on the upper surface of the sequin S, or minimize the distance over which the engaging claw 33*a* slides on the upper surface of the sequin S, with the result that it is possible to effectively prevent any sliding mark from being formed in the upper surface of the sequin S. Further, even in the case where a continuous sequin strip 3 comprising sequins S each having its sewing hole 3*a* offset from the sequin center is used, the instant embodiment allows the sequins S to be fed out reliably because the engaging claw 33*a* of the lock lever 33 in the embodiment does not get in the gap between the sequins S to interfere with the feeding operation.

Because the continuous sequin strip 3 is appropriately guided by the guide walls 102*a* and 102*b* of the guide member 102 during the feed of the sequin strip 3, the sequin strip 3 can be fed straight in the predetermined feeding direction along the guide walls 102*a* and 102*b* even when there has been produced a force causing the sequin S to rotate about the neighborhood of the connecting portion S1.

The following paragraphs describe an example manner in which the various components of the sequin feeder device 6 are adjusted when the reel 5 is replaced with another one so that the sequins S to be sewn onto the embroidering fabric are switched over to sequins differing in size from the previous sequins. The adjustments of the components, as set forth in items (1)-(6) below, may be performed concurrently, or sequentially in any appropriate order.

(1) Adjustment of Sequin Feed Pitch:

In order to adjust the sequin feed pitch, the screw 17 (FIG. 3) fastening the pivot lever 16 is loosened so that the pivot lever 16 can be readily turned with a hand relative to the pivot shaft 15. Further, the stopper 25 is unlocked, and the continuous sequin strip 3 is played out from the reel 5 onto the support plate 8 so that the leading sequin S of the strip 3 projects beyond the front end edge of the support plate 8 as in the "feed completion position" shown in (*b*) of FIG. 8 etc. Also, the pivot lever 16 and feed lever 18 are manually operated to cause the engaging portions 18*a* of the feed lever 18 to engage the sewing hole 3*a* of the second sequin from the leading sequin of the strip 3. Then, the stopper 25 is again locked and the screw 17 is tightened with the feed mechanism, including the pivot lever 16 and feed lever 18, adjusted into the "feed completion position" in accordance with the size of the changed sequin (i.e., newly-set sequin) S.

(2) Adjustment of Lock Lever:

To adjust the lock lever 33, first, the support block 35 is unlocked. Then, the position, in the front-rear direction, of the support block 35 is adjusted manually to adjust the position of the lock lever 33 so that the engaging claw 33*a* of the lock lever 33 engages the sewing hole 3*a* of a predetermined sequin S (third sequin S from the sequin S engaged by the engaging claw 33*a*), as illustrated in (*b*) of FIG. 8, with the stopper portion 33*b* provided at the upper end of the lock lever 33 abutted against the stopper portion 35*a* of the support block 35. Then, the support block 35 is again locked with the lock lever 33 positionally adjusted so that the engaging claw 33*a* of the lock lever 33 engages the sewing hole 3*a* of the predetermined sequin as indicated by the "feed completion position" of FIG. 8 etc.

(3) Positional Adjustment of Sequin's Sewing Hole Relative to Sewing Needle Position:

Positional adjustment between the sewing needle 41 and the sewing hole 3*a* of the sequin S is carried out by adjusting the position of the supporting plate 7 relative to the mounting base 4. Because the supporting plate 7 is mounted to the mounting base 4 via the guide members extending and functioning in the front-rear direction, a lock (not shown) provided in connection with the guide members is brought into an unlocking position so as to allow the supporting plate 7 to be manually moved in the front-rear direction relative to the mounting base 4. Then, the supporting plate 7 is adjusted so that the center of the sewing hole 3*a* of the sequin S, having been delivered from the support plate 8 to a position where the connecting portion S1 vertically aligns with the cutting edge of the fixed cutter blade 8*b*, is located in vertical registry with the center of the sewing needle 41. Upon completion of such adjustment, the guide members and supporting plate 7 are locked and fixed to the mounting base 4.

(4) Replacement of Guide Section:

As necessary, the guide section 12, mounted on the bracket 11, may be replaced with another one that corresponds to the width of the changed sequin (i.e., newly-set sequin) S.

(5) Adjustment of the Adjustment Member 100:

The screw 101 fixing the adjustment member 100 to the feed lever 18 is loosened, and the position of the adjustment member 100 is adjusted so that the adjustment piece 100*a* of the adjustment member 100 is slightly spaced from the lock lever 33 when the feed lever 18 is in the "feed completion position" shown in FIG. 8. Then, the screw 101 is again tightened. As noted above, the timing at which the lock lever 33 pivots (i.e., the timing at which the engaging claw 33*a* engages the sequin S) in response to the advancing and retracting movement of the feed lever 18 depends on the slight spaced-apart distance of the adjustment piece 100*a* from the lock lever 33.

(6) Replacement of Sequin Feed Guide Member 102:

As necessary, the sequin feed guide member 102 is replaced with another one corresponding to the size and shape of the changed sequins (i.e., newly-set sequins) S. Namely, first, the screw 103 is removed to detach the so-far used guide member 102 from the body of the sequin feeder device 6, then another sequin feed guide member 102, corresponding to the size and shape of the changed sequins S, is positioned by being abutted at its inner side edge 102*d* against the side wall 8*c* of the support plate 8, and then the other sequin feed guide member 102 is fixed to the support plate 8 via the screw 103.

FIGS. 12A-13B show modifications of the above-mentioned sequin feed guide member 102 shown in FIG. 7, of which FIGS. 12A and 13A are perspective views of the modifications while FIGS. 12B and 13B are plan views of the modifications.

In FIGS. 12A and 12B, the modified sequin feed guide member 104 is suited for a continuous sequin strip of a type shown in FIG. 14B. The modified sequin feed guide member 104 has a pair of opposed guide walls 104*a* and 104*b*, slit 104*c* and positioning side edge 104*d*, as well as an eave-shaped holding piece 104*e* formed on the upper end of one of the guide walls (in the illustrated example, inner guide edge 104*b*). In each of the sequins of the type shown in FIG. 14B, the sewing hole is formed near one end of the sequin in offset relation to the sequin center and thus located remote from the other end of the sequin. Thus, when the engaging portion 18*a* of the feed lever 18 has engaged the sewing hole of the sequin, a sequin portion at and around the other end of the sequin tend to warp upwardly. Thus, in the modification, the eave-shaped holding piece 104*e* is formed on the upper end of the inner guide edge 104*b* to prevent the upward warping of the sequin portion at and around the other end of the sequin. This modified sequin feed guide member 104 too is formed in such a manner that the slit 104*c* is automatically brought into vertical registry with the slit 8*a* of the support plate 8 as the side edge 104*d* is fixed to the side wall 8*c* of the support plate 8 in abutted relation to the side wall 8*c*, as shown in FIG. 12B. Thus, the modified sequin feed guide member 104 can be properly positioned with ease.

In FIGS. 13A and 13B, the modified sequin feed guide member 105 is suited for a continuous sequin strip of a type shown in FIG. 14C. Each of the sequins of the sequin strip shown in FIG. 14C is a dish-shaped sequin which is known as a "tortoiseshell-shaped sequin". This modified sequin feed guide member 105 has a pair of opposed guide walls 105*a* and 105*b*, slit 105*c* and side edge 105*d*, as well as eave-shaped holding pieces 105*e* formed on the respective upper ends of the two guide walls 105*a* and 105*b*. As the movable cutter blade 27 depresses the connecting portion between the leading sequin and the second sequin to cut off the leading sequin from the tortoiseshell-shaped sequin strip as shown in FIG. 14C, the second and succeeding sequins tend to be pushed upward. Thus, the eave-shaped holding pieces 105*e* are formed on the respective upper ends of the guide walls 105*a* and 105*b* in order to prevent the second and succeeding sequins from being pushed upward during the cutting operation. This modified sequin feed guide member 105 too is formed in such a manner that the slit 105*c* is automatically brought into vertical registry with the slit 8*a* of the support plate 8 as the side edge 105*d* is fixed to the side wall 8*c* of the support plate 8 in abutted relation to the side wall 8*c*, as shown in FIG. 13B. Thus, the modified sequin feed guide member 105 can be properly positioned with ease.

Namely, each of the modified sequin feed guide members 104 and 105 can be readily positioned without requiring particular positional adjustment, and the guide member can be attached and detached easily by tightening and loosening of the single screw 103; thus, each of the modified sequin feed guide members 104 and 105 is replaceable with another one, easily and in a short time, in accordance with the shape and size of the sequins.

In each of the modified sequin feed guide members 104 and 105 of FIGS. 12A-13A too, the guide walls 104*a*, 104*b* or 105*a*, 105*b* may be formed into any desired lengths other than those of the illustrated examples, as long as the continuous sequin strip 3 can be appropriately fed straight in the predetermined feeding direction via the guide walls 104*a*, 104*b* or 105*a*, 105*b*.

In the instant embodiment of the invention arranged in the above-described manner, where the pivot timing of the lock member 33 is adjustable as desired by means of the adjustment member 100, the engaging claw 33*a* of the lock lever 33 can be adjusted to engage the predetermined sequin at or immediately before the sequin feed-out completion time during the forward movement stroke. Thus, the instant embodiment can completely prevent the engaging claw 33*a* from sliding on the upper surface of the sequin S, or minimize the distance over which the engaging claw 33*a* slides on the upper surface of the sequin S, with the result that it is possible to effectively prevent any sliding mark from being formed in the upper surface of the sequin S. Further, even if the continuous sequin strip to be fed is of the type where each sequin has the sewing hole offset from the center of the sequin, the embodiment allows each sequin to be fed out reliably without being interfered by the engaging claw. Further, even when there has been produced a force causing the sequin S to rotate about the neighborhood of the connecting portion S1, the sequin feed guide member allows the sequin to be reliably fed out straight in the predetermined feeding direction. In addition, because the sequin feed guide member can be attached and detached with extreme ease, the sequin feed guide member 102, 104 or 105 is replaceable with another one, easily and in a short time, in accordance with the shape and size of the sequin. As a result, the sequin feeder device equipped with the adjustment member 100 and sequin feed guide member 102, 104 or 105 can appropriately deal with sequins of various types differing from one another in size, shape, etc., and the sequin feeder device 6 is particularly suited for use in feeding of sequins having the sewing hole offset from the center of the sequin.

In the above-described embodiment, the adjustment member 100 and sequin feed guide member 102, 104 or 105 are employed in the sequin feeder device 6 where the engaging claw 33*a* of the lock lever 33 engages the sewing hole 3*a* of a sequin following another sequin engaged by the engaging portion 18*a* of the feed lever 18. However, the sequin feeder device 6, to which the present invention is applied, is not limited to the above-described construction. For example, the engaging claw 33*a* of the lock lever 33 may engage the sewing hole 3*a* of a sequin preceding another sequin engaged by the engaging portion 18*a* of the feed lever 18, as long as the engaging claw 33*a* of the lock lever 33 and engaging portion 18*a* of the feed lever 18 engage the sewing holes 3*a* of different sequins. Further, the lock lever 33 may be constructed in any desired manner without being limited to the lever-like structure, as long as it is a lock means having an engaging projection that engages the continuous sequin strip to immovably lock the sequin strip.

Furthermore, in the case where the continuous sequin strip is of the type where each sequin has the sewing offset formed in its center, the sequin feed guide member 102, 104 or 105 may be omitted.

What is claimed is:

1. A sequin feeder device comprising:

a feed mechanism for feeding a continuous sequin strip, by a predetermined pitch at a time, by movement of a feed member;

a lock member having an engaging projection for engaging the continuous sequin strip to immovably lock the continuous sequin strip; and an adjustment member for adjusting engagement timing at which the engaging projection engages the continuous sequin strip during a continuous-sequin-strip feeding stroke of said feed member.

2. A sequin feeder device as claimed in claim 1, wherein said adjustment member has an adjustment piece for abutting against said lock member to control movement of said lock member and adjust the engagement timing of the engaging projection by a relative position between the adjustment piece and said lock member.

3. A sequin feeder device comprising:

a feed mechanism for feeding a continuous sequin strip onto a support plate by movement of a feed member while the continuous sequin strip is set at a predetermined feed-out position;

a sequin feed guide member for guiding the continuous sequin strip to allow the continuous sequin strip to be fed straight in the predetermined feeding direction, said sequin feed guide member including a guide path corresponding to the continuous sequin strip to be fed, the guide path having a width corresponding to the width of the continuous sequin strip; and a mounting member for detachably mounting said sequin feed guide member at a predetermined mounting position on the support plate, the predetermined feed-out position and the guide path positionally matching each other at the predetermined mounting position, wherein said mounting member allows said sequin feed guide member to be replaced with another sequin feed guide member having a guide path having a width that is different from the width of the guide path of said sequin feed guide member.

4. A sequin feeder device as claimed in claim 3, wherein:

said support plate has a slit with a predetermined length along the predetermined feeding direction to allow an engaging portion of said feed mechanism to bite into the continuous sequin strip passing through the guide path, said sequin feed guide member has a slit of a predetermined length formed therein, and wherein the slit of said sequin feed member overlaps with the slit of said support plate at the predetermined mounting position.

5. A sequin feeder device as claimed in claim 1, further comprising:

a sequin feed guide member for guiding the continuous sequin strip to allow the continuous sequin strip to be fed straight in the predetermined feeding direction, said sequin feed guide member including a guide path corresponding to the continuous sequin strip to be fed; and a mounting member for detachably mounting said sequin feed guide member to a predetermined mounting position.

6. A sequin feeder device as claimed in claim 5, wherein said feed mechanism feeds the continuous sequin strip while the continuous sequin strip is set at a predetermined feed-out position.

7. A sequin feeder device as claimed in claim 6, wherein the predetermined feed-out position and the guide path positionally match each other at the predetermined mounting position.

* * * * *